United States Patent [19]

Inagaki et al.

[11] Patent Number: 4,558,667

[45] Date of Patent: Dec. 17, 1985

[54] VALVE DRIVING APPARATUS FOR AN INTERNAL COMBUSTION ENGINE

[75] Inventors: Takashi Inagaki, Kawagoe; Yasumasa Fujita, Asaka; Shinichiro Izawa, Kamifukuoka, all of Japan

[73] Assignee: Honda Giken Kogyo Kabushiki Kaisha, Tokyo, Japan

[21] Appl. No.: 516,368

[22] Filed: Jul. 22, 1983

[30] Foreign Application Priority Data

| | | | |
|---|---|---|---|
| Jul. 23, 1982 | [JP] | Japan | 57-127567 |
| Jul. 23, 1982 | [JP] | Japan | 57-110982 |
| Aug. 12, 1982 | [JP] | Japan | 57-139124 |
| Aug. 12, 1982 | [JP] | Japan | 57-139125 |
| Aug. 12, 1982 | [JP] | Japan | 57-121617 |

[51] Int. Cl.[4] ..... F01L 1/18

[52] U.S. Cl. ..... 123/90.44; 123/90.27; 123/90.22

[58] Field of Search ..... 123/90.22, 90.27, 90.39, 123/90.44, 90.41, 90.37, 90.38

[56] References Cited

U.S. PATENT DOCUMENTS

| | | | |
|---|---|---|---|
| 1,382,953 | 6/1921 | Church | 123/90.37 X |
| 1,411,208 | 3/1922 | Elliott et al. | 123/90.22 |
| 3,299,871 | 1/1967 | Apfelbeck . | |
| 3,641,988 | 2/1972 | Torazza et al. | 123/90.27 X |
| 3,672,338 | 6/1972 | Yamanouchi | 123/90.38 X |
| 3,722,484 | 3/1973 | Gordini . | |
| 4,308,828 | 1/1982 | Kinsel | 123/90.39 |

FOREIGN PATENT DOCUMENTS

| | | | |
|---|---|---|---|
| 2248063 | 9/1972 | Fed. Rep. of Germany | 123/90.38 |
| 1555310 | 12/1968 | France | 123/90.39 |
| 333621 | 8/1930 | United Kingdom | 123/90.39 |
| 337127 | 10/1930 | United Kingdom | 123/90.39 |

*Primary Examiner*—William R. Cline
*Assistant Examiner*—Peggy A. Neils
*Attorney, Agent, or Firm*—Armstrong, Nikaido, Marmelstein & Kubovcik

[57] ABSTRACT

A valve driving apparatus in an internal combustion engine having plural valve stems in a cylinder head on an upper portion of a main body of an engine which are aligned radially about the cylinder head with the intersection of their longitudinally axes substantially coinciding with a center of curvature of an upper wall surface of a combustion chamber, the valve stems being arranged to be driven by at least one cam shaft through respective subsidiary rocker arms which are in abutment with respective heads of the valve stems and respective rocker arms which are in abutment with the subsidiary rocker arms, characterized in that a shaft for each of the subsidiary rocker arms is positioned on a plane crossing a longitudinal axis of the corresponding one of the valve stems at a right angle and existing in a range of up and down stroke of the head of the valve stem.

6 Claims, 5 Drawing Figures

VALVE DRIVING APPARATUS FOR AN INTERNAL COMBUSTION ENGINE

BACKGROUND OF THE INVENTION

This invention relates to a valve driving apparatus in an internal combustion engine, chiefly in a four-cycle machine for a vehicle. The particular type of engine has plural valve stems disposed in a cylinder head on an upper portion of a main body of the engine. The stems are aligned radially about the cylinder head having the intersection of their longitudinal axes substantially coinciding with a center of curvature of an upper wall surface of a combustion chamber.

A conventional valve driving apparatus is constructed with each of valve stems being driven by being pushed directly by a swing movement of a corresponding rocker arm supported on a shaft which extends in parallel with a cam shaft. However, if such a structure is applied to an engine of the type having plural valve stems aligned radially about the cylinder head with the intersection of their longitudinal axes substantially coinciding with a center of curvature of an upper wall surface of a combustion chamber, it is difficult to align the locus plane of a swing movement of the rocker arm and a longitudinal axial direction of the valve stem. Therefore, there has been proposed an arrangement wherein a subsidiary rocker arm is interposed between a rocker arm and a corresponding valve stem. The locus plane of the swing movement of the subsidiary arm is aligned with the longitudinal axial direction of the valve stem so that the valve stem may be pushed therethrough in the longitudinal axial direction thereof by the rocker arm. It is desirable with this arrangement that a diametrical directional force acting on the valve stem at the time of swing movement of the subsidiary rocker arm is made as small as possible for improving the durability of the valve means.

OBJECT AND SUMMARY OF THE INVENTION

This invention has for its object to provide an apparatus meeting the above-noted desire. This object is obtained in an apparatus of the type that plural valve stems in a cylinder head on an upper portion of a main body of an engine which are aligned radially about the cylinder head with the intersection of their longitudinal axes substantially coinciding with a center of curvature of an upper wall surface of a combustion chamber, the valve stems being arranged to be driven by at least one cam shaft through respective subsidiary rocker arms which are in abutment with respective heads of the valve stems and respective rocker arms which are in abutment with the respective subsidiary rocker arms, wherein a shaft for each of the subsidiary rocker arms is positioned on a plane crossing a longitudinal axis of the corresponding one of the valve stems at a right angle and existing in a range of up and down stroke of the head of the same valve stem.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
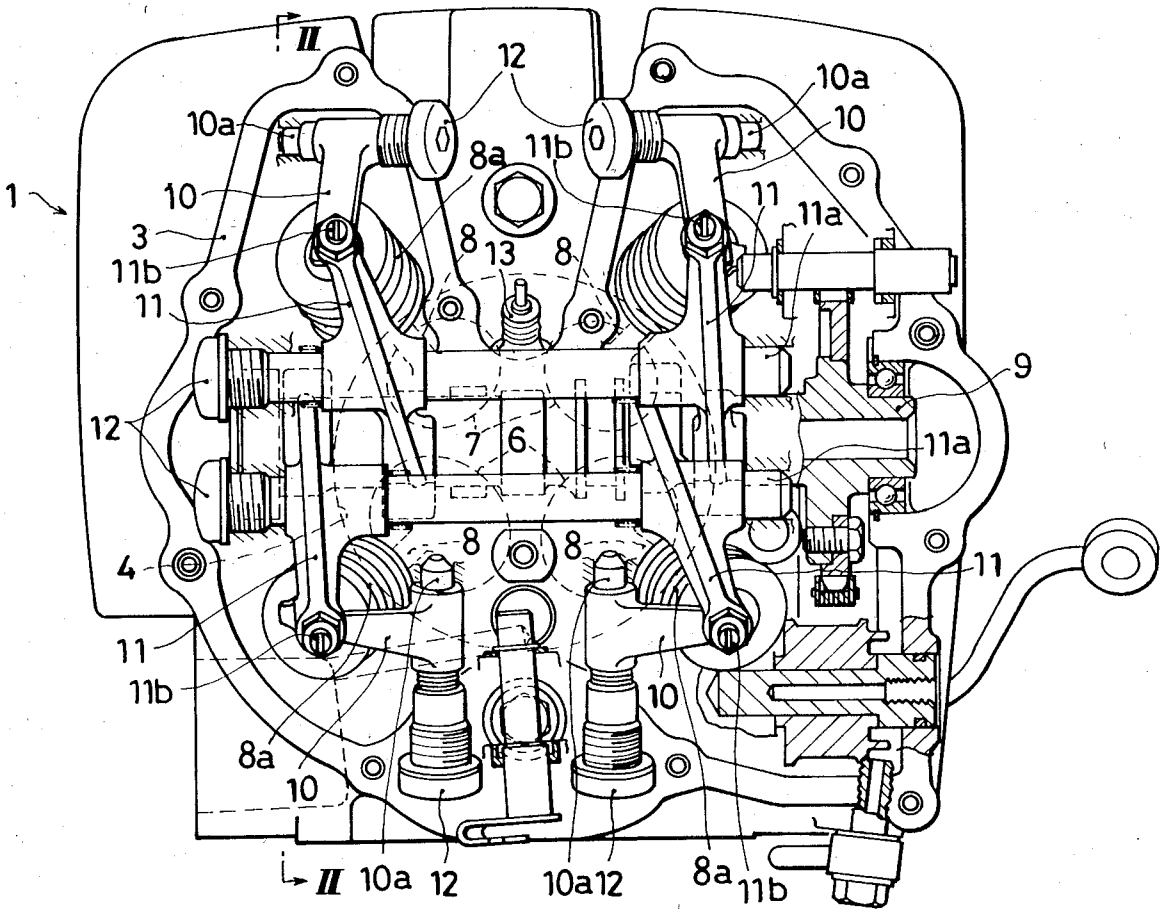
FIG. 1 is a top plan view of one embodiment of this invention, from which a head cover thereof is removed.
Figure 2:
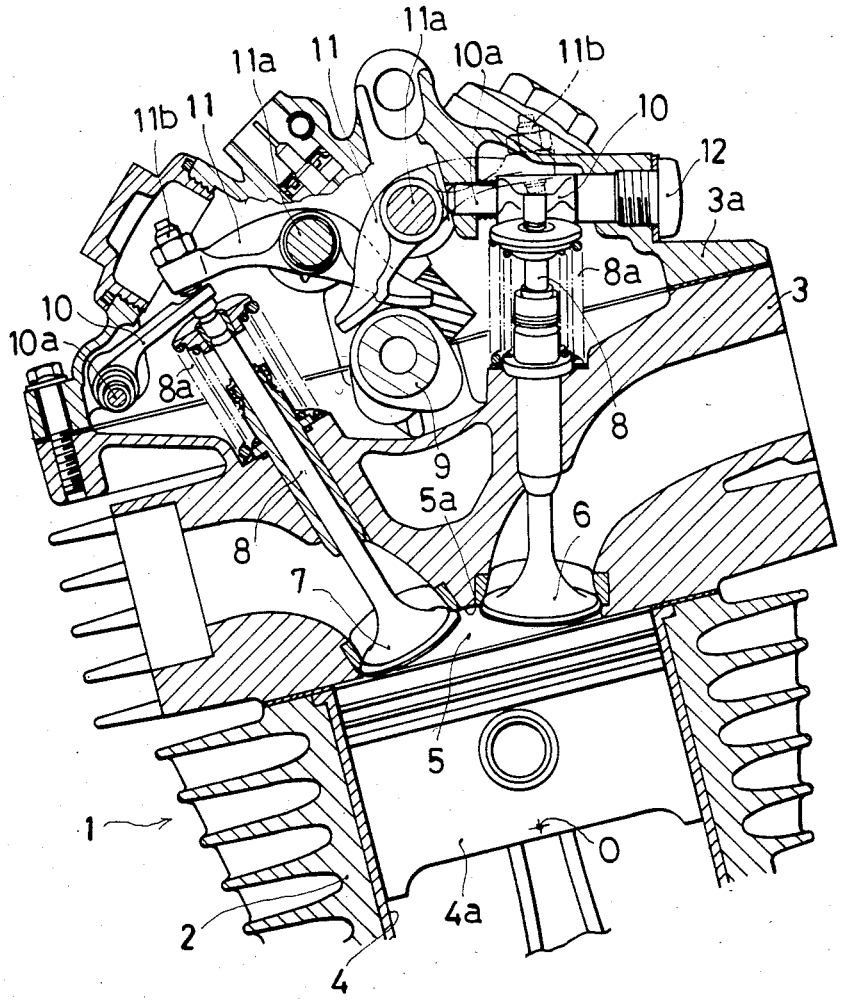
FIG. 2 is a sectional view thereof taken along the line T1-11 in FIG. 1, with the head cover being attached thereto.

Embodying examples of this invention will now be explained with reference to the accompanying drawings:

Referring to FIGS. 1 and 2 showing one example thereof, a main body 1 of an engine is composed of a cylinder block 2 which is a lower part thereof and a cylinder head 3 which is an upper part thereof. A cylinder 4 and a piston 4*a* mounted therein are incorporated in the cylinder block 2 to form on the upward side of the piston 4 a combustion chamber 5. The upper wall surface 5*a* of the combustion chamber 5 is formed as a semi-spherical shaped curve. A pair of right and left intake valves 6, 6 and a pair of right and left exhaust valves 7, 7 are disposed in front and rear relationship. Respective valve stems 8, 8, 8, 8 of those valves 6, 6, 7, 7, are provided in the cylinder head 3 disposed radially about the cylinder head 3 such that the intersection of their longitudinal axes substantially coincides with a center of curvature O of the upper wall surface 5*a*. The valve stems 8 are urged by respective springs 8*a*, 8*a*, 8*a*, 8*a*, and a cam shaft 9 which extends longitudinally in the right and left directions. The cam shaft 9 is turnably supported on the cylinder head 8 so as to be positioned between the valve stems 8, 8 on the front side and the valve stems 8, 8 on the rear side.

These valve stems 8, 8, 8, 8 are arranged to be driven by the cam shaft 9 through respective subsidiary rocker arms 10, 10, 10, 10 and respective rocker arms 11, 11, 11, 11.

More in detail, a pair of shafts 11*a*, 11*a* for the rocker arms 11, 11, 11, 11 are provided in parallel with the cam shaft 9. The two rocker arms 11, 11 for the pair of intake valves 6, 6 are supported on one of the shafts 11*a*, 11*a*, and the two rocker arms 11, 11 for the pair of exhaust valves 7, 7 are supported on the other. An end portion of each of the rocker arms 11, 11, 11, 11 is arranged to face a head of the corresponding one of the valve stems 8, 8, 8, 8. In a gap formed therebetween, there is inserted a swingable end portion of the corresponding one of the subsidiary rocker arms 10, 10, 10, 10 supported on respective shafts 10*a* described hereinafter, so that if the cam shaft 9 is turned, the respective subsidiary rocker arms 10, 10, 10, 10 may be given a swing movement through the respective rocker arms 11, 11, 11, 11. In this manner, each of the respective valve stems 8, 8, 8, 8 is given a constant stroke of upward and downward movement at predetermined timings.

Referring to the drawings, an adjusting bolt 11*b* is provided on the end portion of each rocker arm 11. Stopper bolts 12 for respective shafts 10*a*, 11*a*, and an ignition plug 13 are also provided.

Figure 3:
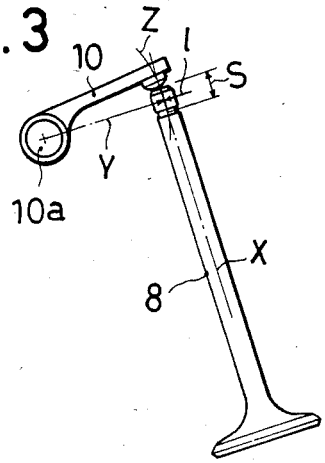
FIG. 3 is a diagrammatical side view of an important portion thereof.

According to this invention, as shown clearly in FIG. 3, the shaft 10*a* for each subsidiary rocker arm 10 is positioned on a plane which crosses the longitudinal axis X of the corresponding valve stem 8 at a right angle thereto and exists in an up and down stroke range S of the head of the valve stem 8. Owing to this arrangement, even if the corresponding rocker arm 11 can be taken at any desired position in relation to each subsidiary rocker arm 10, the end portion of the subsidiary rocker arm 10 always moves along on a plane including the longitudinal axis X of the valve stem 8, and the amount of diametrically directional deflection $\mu$ of the swing movement locus Z of the arm 10 in relation to the longitudinal axis X is made as small as possible. In this manner, the valve stem 8 can be driven by being pushed straight in the axis X direction thereof while hardly being applied with a diametrical directional force.

In the foregoing example, the shafts 10*a*, 10*a*, 10*a*, 10*a* of the subsidiary rocker arms 10, 10, 10, 10 and the shafts 11*a*, 11*a* of the rocker arms 11, 11, 11, 11 are supported on a detachable head cover 3*a* constituting an upper half portion of the cylinder head 3 so that mounting and demounting of the valve drive mechanism may be carried out simply by attaching and detaching of the head cover 3*a*. This results in an improvement in the maintenance and assembly attributes thereof. Additionally, in this embodiment, the subsidiary rocker arms 10, 10 for the intake valves 6, 6 are provided according to the shape of the head cover 3*a* to extend longitudinally in the direction at right angles with the lengthwise directions of the corresponding rocker arms 11, 11. The subsidiary rocker arms 10, 10 for the exhaust valves 7, 7 are provided to extend longitudinally in the lengthwise directions of the corresponding rocker arms 11, 11.

Figure 5:
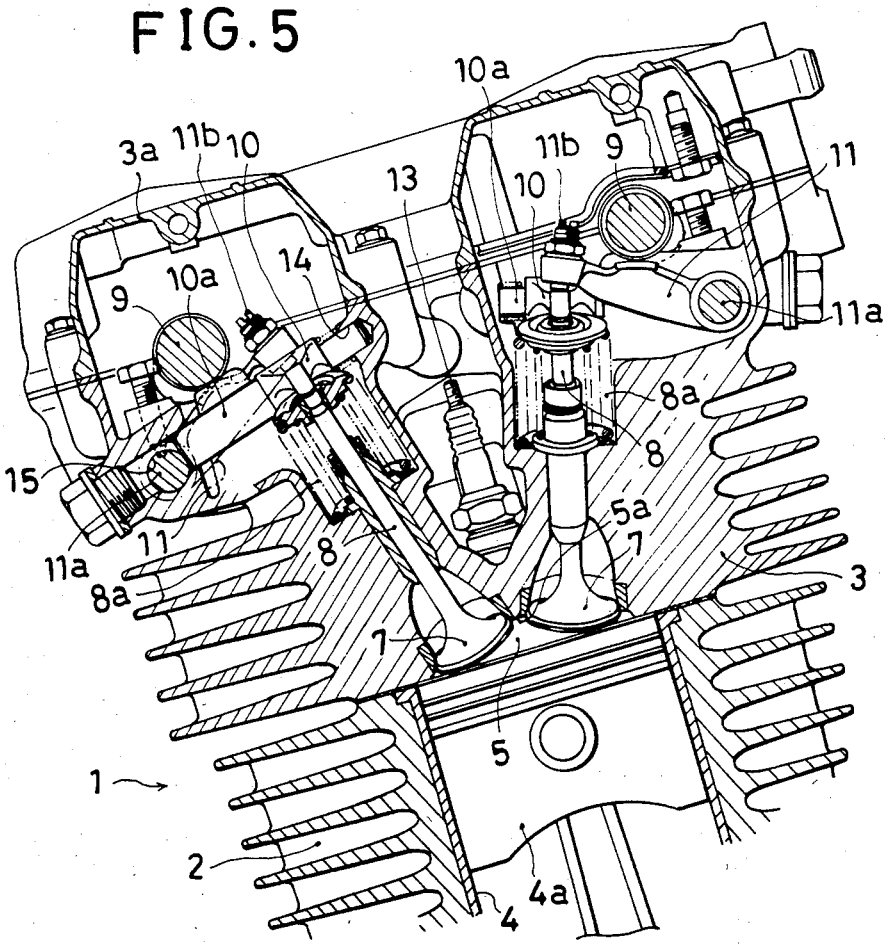
FIG. 5 is a sectional view taken along the line V—V in FIG. 4.
Figure 4:
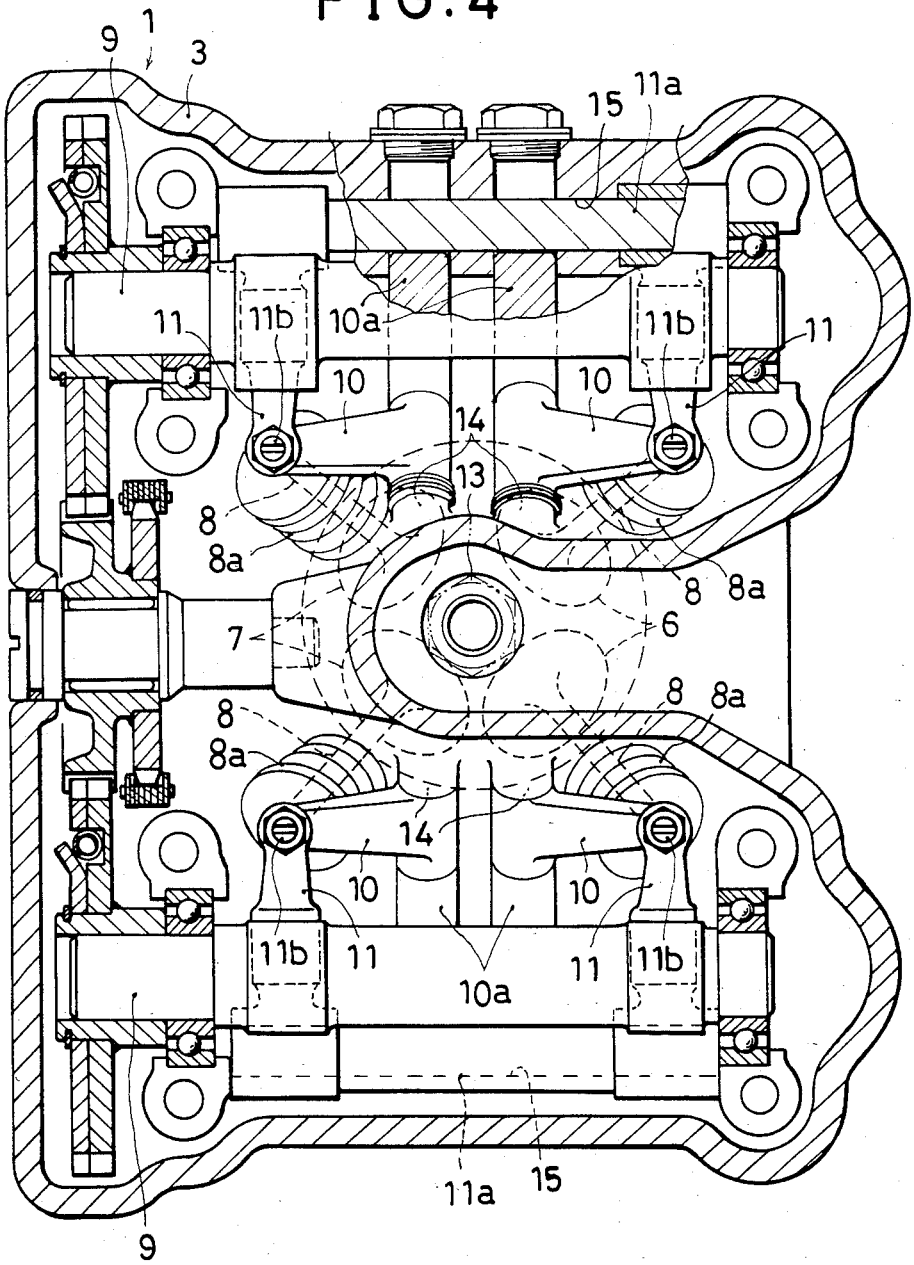
FIG. 4 is a sectional top plan view of another embodiment of this invention.

In another embodiment of this invention shown in FIGS. 4 and 5, the intake valves 6, 6 are disposed to be a pair of front and rear ones in the right side, and the exhaust valves 7, 7 are so disposed as to be a pair of front and rear ones on the left side. Each of the two cam shafts 9, each of which lies longitudinally in the right and left directions, is disposed on the front and rear outer sides of the foregoing disposition of the valve stems 8, 8, 8, 8. Each pair of right and left rocker arms 11, 11 for the respective intake valve 6 and the exhaust valve 7 on each of the front and rear sides are supported on each of the rocker arms shafts 11*a*, 11*a* provided in parallel with the respective cam shafts 9, 9. In addition, in the illustrated example, each pair of subsidiary rocker arms 10, 10 are provided in an interval space between each corresponding pair of the valve stems 8, 8, for instance, in the corresponding interval space between the corresponding pair of right and left valve stems 8, 8 that is formed on each of the front and rear sides. In this manner, a compact housing of them in the cylinder head 3 can be made. Additionally, the shafts 10*a*, 10*a* for each pair of subsidiary rocker arms 10, 10 on each of the front and rear sides are disposed in parallel one with another. Bearing bores 14, 14 for these shafts 10*a*, 10*a* are formed in the cylinder head 3 itself, so that an accuracy in the relative positioning between each subsidiary rocker arm 10 and each valve stem 8 inserted in the cylinder head 3 can be improved. Also, each pair of the bearing bores 14, 14 can be formed simultaneously by working on the cylinder head 3 from the same direction, resulting in improvement in working efficiency.

Further, in the illustrated example, the shafts 11*a*, 11*a* for the rocker arms 11, 11 on each of the right and left sides are arranged to be inserted in and supported by respective bearing bores 15 made in the cylinder head 3 itself. Each of the shafts 10*a*, 10*a* for each of subsidiary rocker arms 10, 10 is disposed in parallel with a plane at right angles with the corresponding shaft 11*a* for the corresponding rocker arms 11, 11 so that the angular difference between the bearing bores 14, 15 for the respective shafts 10*a*, 11*a* becomes a right angle. Thus, the positioning thereof on working may be facilitated and the working accuracy may be improved. Furthermore, in the illustrated example, the bearing bores 14, 15 cross one another. The respective shafts 10*a*, 11*a* inserted into the respective bores 14, 15 are mutually met at right angles. In this case, an end surface of one of them, that is, one end surface of the shaft 10*a* of the subsidiary rocker arm 10, for instance, is in abutment with and supported by a circumferential surface of the other thereof, that is, of the shaft 11*a* of the rocker arm 11, for instance. Thus, the positioning of the shaft 10*a* later inserted in the bore 14 may be facilitated by utilizing as a positioning member the shaft 11*a* earlier inserted in the bore 15.

Thus, according to this invention, the shaft for each subsidiary rocker arm is provided on a plane crossing at right angles the longitudinal axis of the corresponding valve stem and existing in the up and down stroke range of the head thereof, so that a diametrical directional force acting on the valve stem can be made as small as possible. At the same time the valve stem can be driven by being pushed straight in the longitudinal axis direction by the subsidiary rocker arm. Accordingly, the valve means can be improved in its durability. Additionally, each rocker arm can be provided at any desired position in relation to the corresponding subsidiary rocker arm and then the freeness of designing of the apparatus can be increased.

It is readily apparent that the above-described valve driving mechanism meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A valve driving apparatus in an internal combustion engine having plural valve stems for each cylinder in a cylinder head on an upper portion of a main body of the engine which are aligned radially about the cylinder head with the intersection of their longitudinal axes substantially coinciding with a center of curvature of an upper wall surface of a combustion chamber, the cylinder head including a lower half portion having the valve stems therein and an upper half portion constituted by a detachable head cover; the valve driving apparatus including:

at least one cam shaft rotatably clamped in between the lower half portion of the cylinder head and the head cover, a plurality of subsidiary rocker arms, each having one end in abutment with a head of one of the valve stems, subsidiary rocker arm shafts, each pivotally mounting one of the subsidiary rocker arms and being inserted in and supported by a bearing bore formed directly in one of the lower half portion and the upper half portion of the cylinder head, each shaft having a center axis positioned in a plane which crosses a longitudinal axis of the corresponding one of the valve stems at a right angle and which also is substantially located to include a mid-point of a range of up and down stroke of the head of the valve stem, a plurality of respective rocker arms driven by said at least one cam shaft and driving the subsidiary rocker arms, and respective rocker arm shafts pivotally mounting the respective rocker arms and each being inserted in and supported by at least one bearing bore formed directly in one of the lower half portion and the upper half portion of the cylinder head;

at least one pair of the subsidiary rocker arms which are in abutment with a corresponding pair of valve stems being positioned between the corresponding pair of valve stems, the subsidiary rocker arm shafts mounting said at least one pair of subsidiary rocker arms being disposed in parallel with one another and in parallel with a plane at right angles with the corresponding respective rocker arm shaft.

2. The apparatus of claim 1, wherein the shafts for the subsidiary rocker arms and the shafts for the respective rocker arms are inserted in and supported by the bearing bores formed directly in the detachable head cover.

3. The apparatus of claim 1, wherein two pairs of subsidiary rocker arms which are in abutment with corresponding pairs of valve stems are positioned between their corresponding pairs of valve stems, and the subsidiary rocker arm shafts mounting each pair of subsidiary rocker arms are disposed in parallel with one another and in parallel with a plane at right angles with the corresponding respective rocker arm shaft.

4. The apparatus of claim 1 having two cam shafts disposed in parallel.

5. The apparatus of claim 1, wherein the shafts for the subsidiary rocker arms and the shafts for the respective rocker arms are inserted in and supported by bearing bores formed directly in the lower half of the cylinder head.

6. The apparatus of claim 1, wherein each of the shafts for the subsidiary rocker arms and each of the shafts for the corresponding respective rocker arms are disposed to meet at right angles with one another, and an end surface of each of the two shafts is in abutment with and supported on a circumferential surface of each of the others.

* * * * *